US006842142B2

(12) United States Patent
Takesako et al.

(10) Patent No.: US 6,842,142 B2
(45) Date of Patent: Jan. 11, 2005

(54) ANTENNA AND COMMUNICATION EQUIPMENT INCORPORATING THE ANTENNA

(75) Inventors: Setsuo Takesako, Osaka (JP); Koji Sako, Okayama (JP); Yoshinobu Nakagawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/386,800

(22) Filed: Mar. 12, 2003

(65) Prior Publication Data

US 2003/0179144 A1 Sep. 25, 2003

(30) Foreign Application Priority Data

Mar. 15, 2002 (JP) ..... 2002-071877

(51) Int. Cl.[7] ..... H01Q 1/38

(52) U.S. Cl. ..... 343/700 MS; 343/702

(58) Field of Search ..... 343/700 MS, 702

(56) References Cited

U.S. PATENT DOCUMENTS 6,433,747 B1 * 8/2002 Cumro et al. ..... 343/700 MS
6,437,747 B1 * 8/2002 Stoiljkovic et al. ..... 343/702

* cited by examiner

*Primary Examiner*—James Vannucci
(74) *Attorney, Agent, or Firm*—RatnerPrestia

(57) ABSTRACT

A built-in type antenna, with which the electrical connection to a wiring pattern on wiring board can be managed with ease, and the electrical connection can be implemented within a small area. The antenna comprises a base body, on which an antenna element portion is fixed, and a conductive pin having electrical connection with the antenna element portion is disposed in the base body so that the pin can move ups and downs. The bottom end of conductive pin makes an elastic contact to a wiring pattern on wiring board.

8 Claims, 9 Drawing Sheets

ANTENNA AND COMMUNICATION EQUIPMENT INCORPORATING THE ANTENNA

BACKGROUND OF THE INVENTION

1. Field of the Invention

The present invention relates to a built-in type antenna for use within inside of an equipment, and a communication equipment incorporating the antenna.

2. Background Art

Portable telephone units and the like communication equipment are penetrating rapidly among our daily life. There are varieties of antennas available for incorporation in such equipment. Among the antennas, the recent preference is on a built-in type ones which are used incorporated in the inside of equipment cabinet.

A conventional built-in type antenna is described referring to FIG. 7 through FIG. 9.

FIG. 7 is a perspective view of communication equipment having a conventional built-in type antenna. FIG. 8 is a cross sectional view used to describe the key part, or a state how the antenna is mounted on a wiring board.

Referring to FIG. 7, a cabinet 101 of approximately rectangular parallelepiped shape with hollowed inside has on the front operation face a receiver portion 102, a display portion 103, an operating key portion 104 and a transmitting portion 105, in the order from the above.

Functional parts and the electronic components needed to operate the above-described receiver portion 102 through transmitting portion 105 are mounted on a wiring board 106 (see FIG. 8), which is supported and fixed in the inside of cabinet 101 at a certain specific position.

Microcomputer and the like control components for controlling the above parts and electronic components are mounted likewise on the wiring board 106. These parts and components exchange information among each other in order to put receiver portion 102, display portion 103, operating key potion 104 and transmitting portion 105 into operation.

A built-in type antenna 107 which transmits and receives radio waves (hereinafter referred to as built-in antenna 107) is also attached on wiring board 106, as shown in FIG. 8. The built-in antenna 107 is incorporated within cabinet 101.

FIG. 9 shows a perspective view of the built-in antenna 107. It is formed of a resin base body 108 having an approximate parallelepiped shape and a conductive metal sheet 109 functioning as the antenna element fixed on the upper surface. Shapes of resin base body 108 and conductive metal sheet 109 have been determined so that they are in conformity with a certain specific frequency region.

Built-in antenna 107 is attached and fixed to a certain predetermined location by inserting an elastic claw 108A, which is extending downward from the bottom of base body 108, through a cut 106A of wiring board 106 and hooking it on the reverse surface of wiring board 106.

Conductive metal sheet 109 in the above built-in antenna 107 has extensions to form a supply terminal 109A and a ground terminal 109B, respectively. Each of supply terminal 109A and ground terminal 109B is creeping down from the upper surface along the side wall surface of base body 108 with a certain specific width. The end parts of these terminals are bent to the form of a letter "L", at the bottom level of base body 108.

As described in the above, the elastic arms extending from conductive metal sheet 109, or supply terminal 109A and ground terminal 109B, make at the bottom surface of L-bent sheet an elastic contact with wiring patterns 106B and 106C, respectively, provided on wiring board 106, in a state where built-in antenna 107 is mounted on wiring board 106 (see FIG. 8).

Built-in antenna 107 receives and outputs information via these wiring patterns 106B, 106C, supply terminal 109A and ground terminal 109B; and is controlled by the above-described control components which are connected by way of wiring patterns 106B, 106C. And the control components put other parts and electronic components into operating stage in accordance with the input/output information.

Description on a state how these control components control other components, and how the other components are functioning, are eliminated here.

A conventional built-in antenna 107 has the above-described structure, and mounted in the way as described above.

In the above-configured conventional built-in antenna 107, however, the supply terminal 109A and the ground terminal 109B making elastic contact on the wiring patterns 106B, 106C of wiring board 106 have a shape of a long elastic arm, made of an elastic metal sheet extended for a long distance along the side wall surface of base body 108. Therefore, it is difficult to keep the positioning accuracy under control. A resultant problem is that a wiring board 106 has to provide sufficient margin areas for the respective wiring patterns 106B, 106C.

SUMMARY OF THE INVENTION

Antenna of the present invention comprises a base body, an antenna element portion attached and fixed on the base body, and a conductive pin electrically connected with the antenna element portion and disposed in the base body so that it can move ups and downs in the vertical direction.

A communication equipment of the present invention comprises an antenna mounted on the wiring board, which antenna comprising a base body, an antenna element portion attached and fixed on the base body, and a conductive pin electrically connected with the antenna element portion and disposed in the base body so that it can move ups and downs in the vertical direction. The antenna is electrically connected with a wiring pattern formed on the wiring board by means of a conductive pin disposed in the base body.

DETAILED DESCRIPTION OF THE EXEMPLARY EMBODIMENTS

Figure 1:
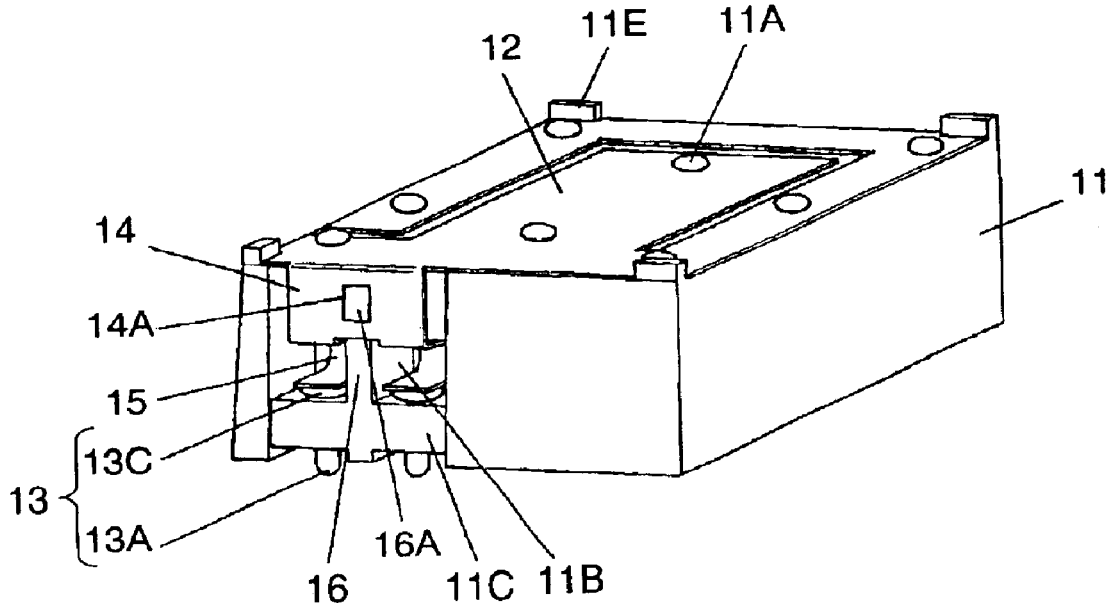
FIG. 1 is a perspective view of a built-in type antenna in accordance with an exemplary embodiment of the present invention.

The present invention addresses the conventional problems as described in the above, and aims to offer a built-in type antenna with which the electrical contact to a wiring pattern of wiring board can be managed easily, and area needed for implementing the electrical contact is small. The present invention also contains a communication equipment which incorporates the built-in type antenna.

Exemplary embodiments of the present invention are described referring to the drawings in FIG. 1 through FIG. 6.

Embodiments

Figure 2:
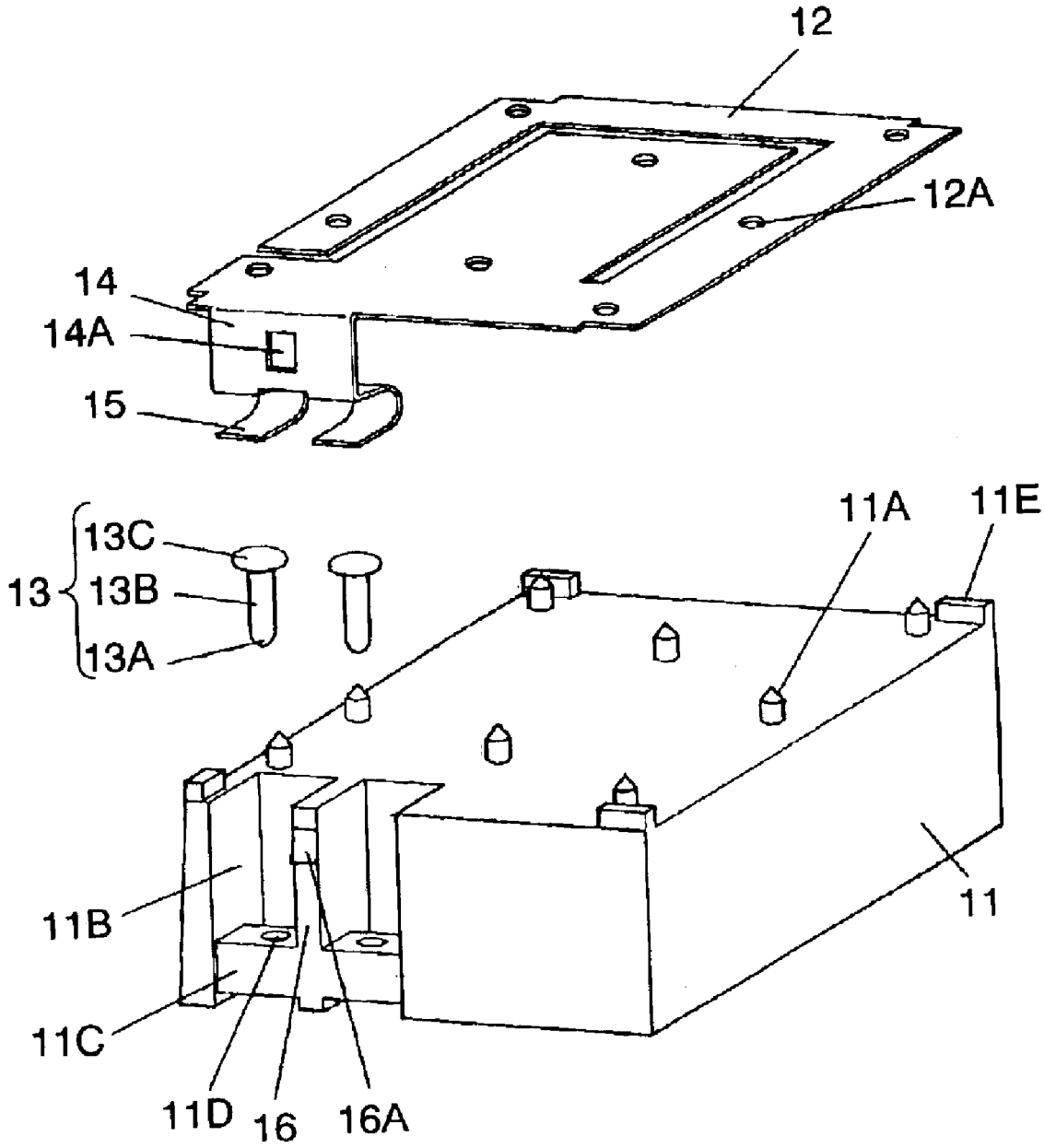
FIG. 2 shows an exploded perspective view of the built-in type antenna of FIG. 1.
Figure 3:
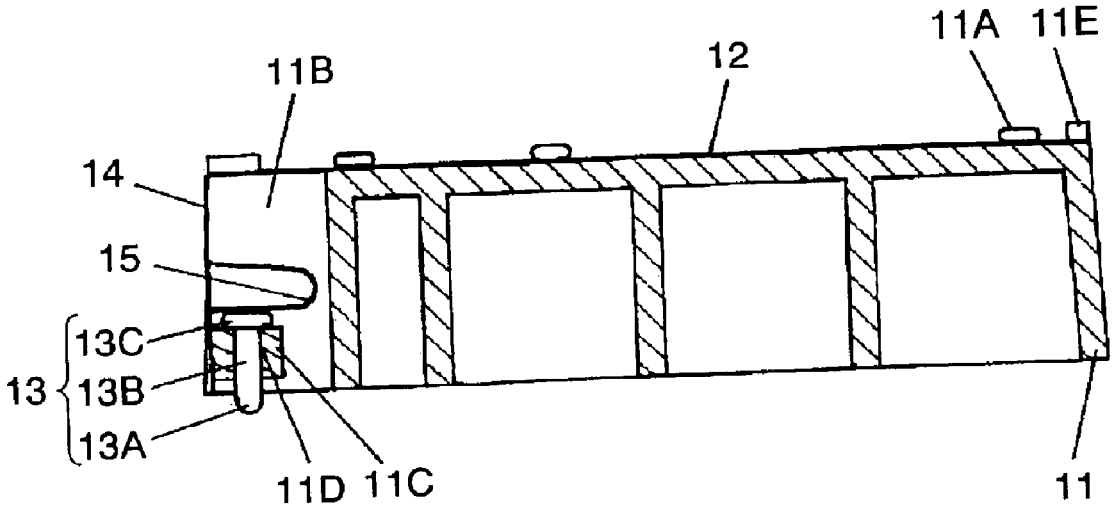
FIG. 3 is a cross sectional view showing the key part of a built-in type antenna. A state of connection between the conductive pin and the antenna element portion is shown.

FIG. 1 shows perspective view of a built-in type antenna in accordance with an exemplary embodiment of the present invention. FIG. 2 shows an exploded perspective view of the built-in type antenna of FIG. 1. FIG. 3 is a cross sectional view showing the key part of built-in type antenna of FIG. 1; a state where the conductive pin and the antenna element portion are having contact.

Referring to FIG. 1, an antenna element portion 12 made of a conductive metal sheet is fixed on the upper surface of a base body 11 made of an approximately parallelepiped resin.

Antenna element portion 12 is fixed on base body 11 by accepting a protrusion 11A provided on the upper surface of base body 11 penetrating through a fixing hole 12A provided in antenna element portion 12 at a certain specific location, and then caulking the protrusion 11A from above the antenna element portion 12, as shown in FIG. 2.

In one of the side walls of base body 11, a groove 11B having openings towards the upper surface and the side face is provided in two places in parallel. At the bottom portion 11C of respective grooves is a conductive pin holder 11D.

As shown in FIG. 3, a conductive pin 13 made of metal or the like conductive material is inserted through the conductive pin holder 11D so that it can move ups and downs, which holder being a round through hole.

Conductive pin 13 has an approximate round column shape in the middle part 13B, the bottom end 13A of which column has been formed to be spherical while the top end is provided with a brim 13C, the diameter of which is greater than that of conductive pin holder 11D.

Because conductive pin 13 is provided with the brim 13C, conductive pin 13 is positioned by itself to a right place relative to base body 11. So, when disposing the conductive pin 13, an automatic dispensing machine, for example, can be used; where the machine drops a conductive pin 13 and the pin goes along the conductive pin holder 11D.

Meanwhile, antenna element portion 12 has a side plate 14 which covers base body 11's two grooves 11B in the upper part of the side face opening.

Side plate 14 is provided in the lower part with elastic arms 15 disposed side by side corresponding to the location of respective grooves 11B.

Elastic arms 15 are formed in the same shape. The bottom end of side plate is extended at two places corresponding to grooves 11B, which extensions are bent towards inside of base body 11. The extensions are curved in the middle part towards inside to form an approximate shape of a letter "U". The end part of the extension is making an elastic contact on brim 13C of conductive pin 13.

Namely, each of the elastic arms 15 is providing respective conductive pins 13 with a downward force.

The elastic arms 15 are disposed housed in grooves 11B, and length of elastic arm 15 in terms of the vertical direction has been shortened for a length corresponding to that of conductive pin 13. So, the elastic arms 15 can be managed with ease.

Conductive pins 13 pressed by resilient force of elastic arms 15 make contact at the bottom surface of brim 13C with the upper surface of the bottom portion 11C of groove 11B, making the bottom ends 13A to extrude out of the bottom level of base body 11.

The two conductive pins 13 function, respectively, as the supply terminal and the ground terminal for antenna element portion 12.

Side plate 14 is provided with a hole 14A, which hole is engaging with a protrusion 16A provided on an wall 16 locating between the two grooves 11B of base body 11.

The above engagement is aimed to prevent the side plate 14, etc. from getting lifted up by a resilient force of elastic arm 15 or other elements.

Base body 11 has contacting protrusions 11E provided at the corners of the upper surface. The contacting protrusion 11E has a height that is greater than that of protrusion 11A of base body 11 after caulking.

Base body 11, antenna element portion 12, etc., as well as conductive pin 13, have been shaped to be consistent with a certain specific frequency band.

So far, a built-in type antenna in accordance with the present embodiment (hereinafter referred to as built-in antenna) has been described.

Now in the following, a communication equipment having the built-in antenna is described, and a state of built-in antenna after it is mounted in the communication equipment is also described.

Figure 4:
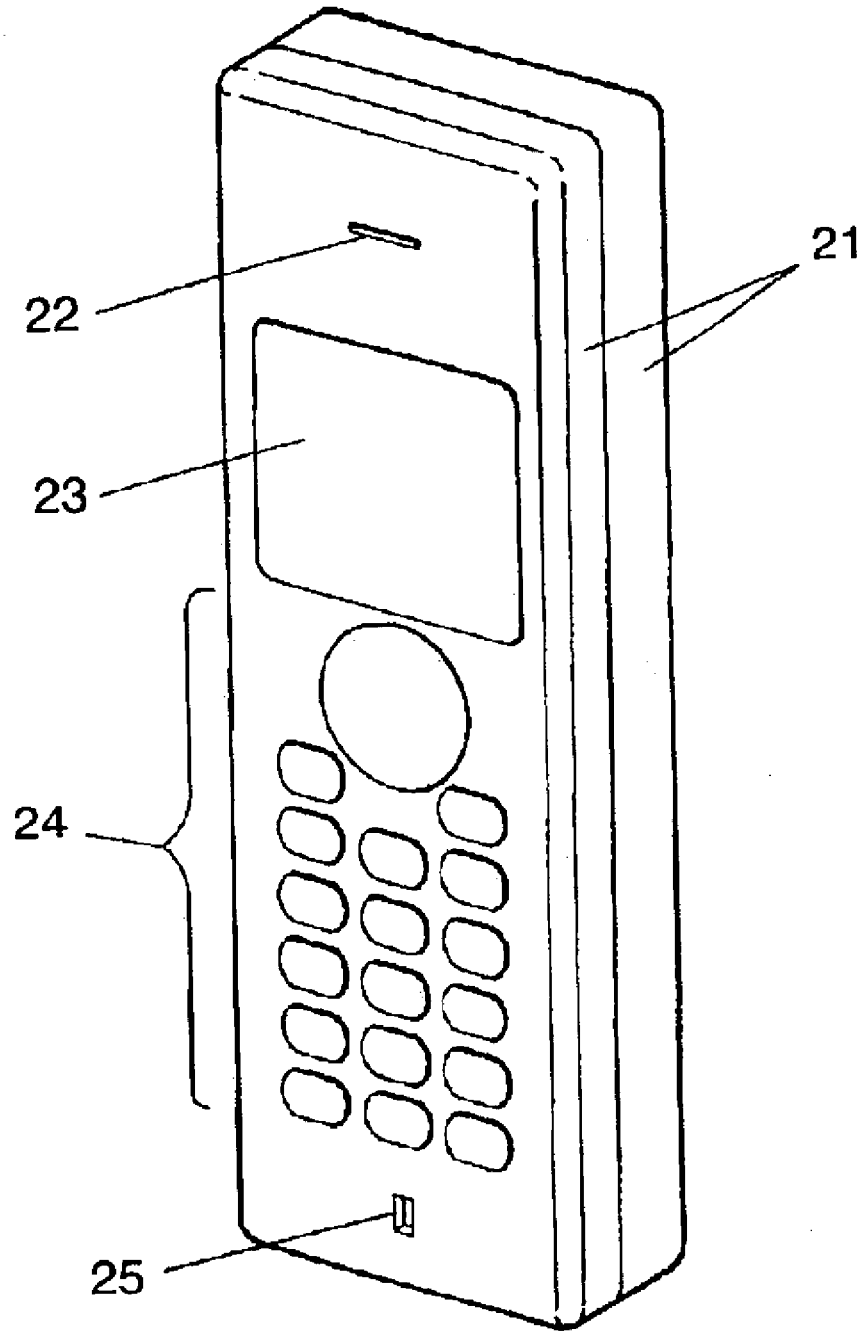
FIG. 4 is a perspective view showing a communication equipment incorporating a built-in type antenna of the present invention.
Figure 5:
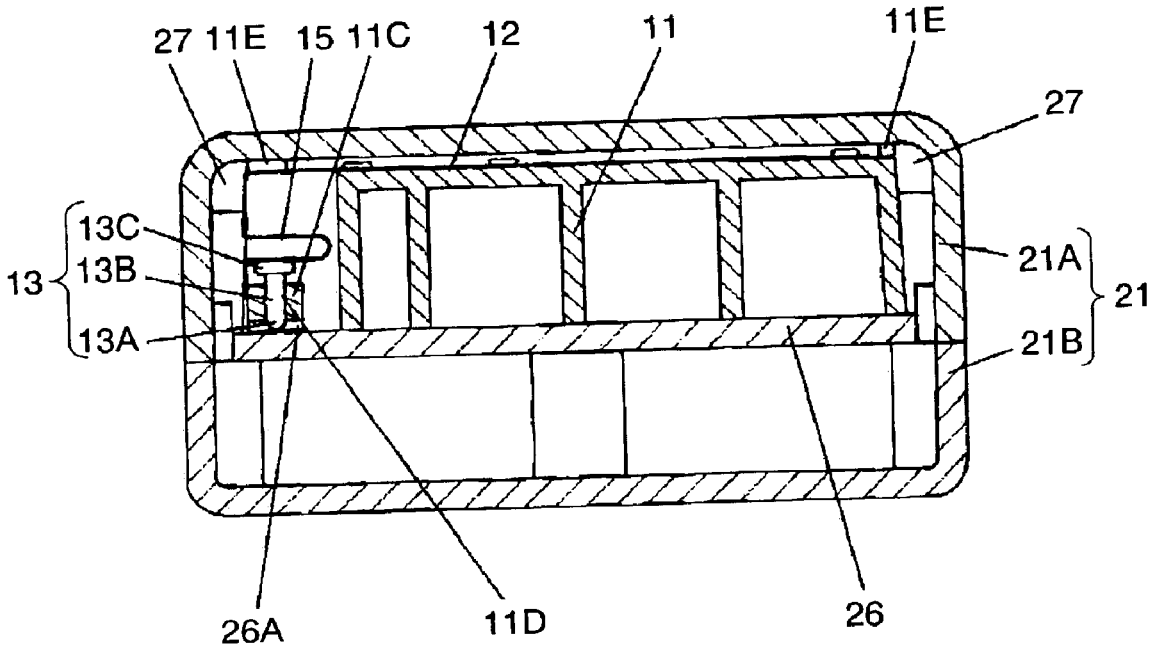
FIG. 5 is a cross sectional view showing the key part of the communication equipment. A state of antenna being mounted therein is shown.

FIG. 4 shows perspective view of a communication equipment having the built-in antenna; FIG. 5 is a cross sectional view showing the key part of the communication equipment of FIG. 4, or a state of the built-in antenna after it is mounted.

The present communication equipment is covered with a hollowed parallelepiped case 21, as illustrated in FIG. 4. On the front face of which case 21, a receiver portion 22, a display portion 23, an operating key portion 24 and a transmitting portion 25 are disposed, in the order from the above.

Inside the case 21, a wiring board 26 is held supported precisely at a specified location, as shown in FIG. 5. Although not shown in FIG. 5, various parts and electronic components are mounted on the wiring board 26 for operating and controlling the receiver portion 22, display portion 23, operating key portion 24, transmitting portion 25 and other sectors.

The wiring board 26 is mounted also with a built-in antenna in the present embodiment.

The built-in antenna is housed and fixed in the case in a following manner: Base body 11 is put into a first case 21A of case 21 so that the upper part of base body 11's side wall is supported by a protrusion 27 for holding antenna provided in the inner surface of first case 21A, and then first case 21A is precisely engaged with a second case 21B. Then the antenna in the present embodiment is held and fixed in terms of the up-down direction by the inner surface of first case 21A and wiring board 26.

At this stage, the bottom of base body 11 is in contact with wiring board 26, while a contacting protrusion 11E provided at the corner of upper surface of base body 11 is having contact with the inner surface of first case 21A.

The protrusion 27 for holding antenna is provided in first case 21A at each of the places arranged to encounter forces in the front-rear and the right-left directions. Thus the built-in antenna in the present embodiment is regulated by the protrusions 27 for holding antenna. So, the built-in antenna does not shift the location in first case 21A; neither in the front-rear direction nor in the right-left direction.

The built-in antenna thus mounted is in contact with wiring board, with the conductive pins 13 disposed in the base body 11 making elastic contact at respective bottom ends 13A on certain specific wiring patterns 26A of wiring board 26.

As described in the above, the base body is provided with holding means to the wiring board. The holding means holds the wiring board with a holding force that is stronger than the resilient force of conductive pin being in contact with wiring pattern of wiring board.

Although not distinguished in the drawing by providing different symbols, respective wiring patterns 26A are those which operate on the two conductive pins 13 functioning as a supply terminal and a ground terminal.

When, respective conductive pins 13, to which a downward spring force is provided by the elastic arm 15 of antenna element portion 12, are pushed up forcedly by wiring board 26 despite the spring force originally provided thereon. Then, the bottom end 13A of conductive pin 13 is provided with a total downward force of the original spring force plus an additional spring force generated by the elastic arm 15 additionally bent as the result of upward shift of conductive pin 13 for an amount corresponding to the shift quantity. Thus the bottom end 13A presses wiring pattern 26A with a certain predetermined force, and respective conductive pins and wiring patterns implement a stable electrical connection.

The pushing-up of elastic arm 15 is conducted in a stable manner with a large-diameter brim 13C of conductive pin 13.

Even if it is structured so that conductive pin 13 does not receive any pressing force from elastic arm 15 before antenna is mounted, the elastic arm 15 is bent when the conductive pin 13 is pushed up, and a force is generated to press the conductive pin 13 downward. Therefore, even in a case of the above-configured antenna, it can be mounted so that the conductive pin 13 makes an elastic contact.

Motion of a conductive pin 13, which pin being held movable ups-and-downs within conductive pin holder 11D, is restricted by the inner wall of conductive pin holder 11D, so the conductive pin 13 does not make material inclination in the motion. Furthermore, conductive pin 13 moves along a direction approximately perpendicular to the surface of wiring board 26, so there can be no substantial dislocation in the landing spot of bottom end 13A. Thus the bottom end 13A can be landed on wiring board 26 at a precise location. As a result, relevant wiring pattern 26A can be made finer.

Since the bottom end 13A has an approximate spherical shape, it implements a stable contact at a certain specific point. It creates a stable electrical connection with a high contact pressure.

As described in the above, a built-in antenna in the present embodiment implements an electrical contact by pressing the bottom end 13A of conductive pin 13, which can move ups and downs, on a wiring pattern 26A from the above. Therefore, it has a high accuracy in targeting a spot, and an electrical contact can be implemented in a smaller area.

Since a built-in antenna in the present embodiment is mounted by holding the top and the bottom of base body 11 with first case 21A and wiring board 26, even if a casual shock is caused by an inadvertent drop of an equipment the base body 11 may not be dislocated in an up-down direction. Therefore, influence upon the contact between conductive pin 13 and wiring pattern 26A of wiring board 26 will be staying minimal.

As described in the above, in a communication equipment having an antenna of the present invention, a space needed for implementing electrical contact with the antenna can be reduced, and the state of electrical connection is stable.

Furthermore, since the middle part 13B of conductive pin 13 in the present built-in antenna is housed surrounded by base body 11, the conductive pin 13 is guarded against a deformation or the like troubles. Therefore, it can be managed easily during transportation and storage. Rejects due to the deformation, etc. are reduced, and the reliability of an equipment is improved.

Descriptions on operation of the built-in antenna, receiver portion 22, display portion 23, operating key portion 24 and transmitting portion 25 in the present communication equipment, as well as operation of control sections for controlling these portions mounted on wiring board 26, are eliminated here.

Descriptions in the above embodiments have been based on such a built-in antenna whose conductive pin 13 which is being pressed downward is protruding at the bottom end 13A from the bottom surface of base body 11 before it is mounted on a wiring board 26 or other object, and on such a communication equipment incorporating the built-in antenna. However, the same advantage can be realized with a built-in antenna of other model in which the bottom end of conductive pin is concealed within the base body before mounting; by electrically connecting a protruding pin on a certain wiring pattern of wiring board, and inserting it into conductive pin holder of base body from the bottom to push the conductive pin up.

Although the above descriptions have been based on such a conductive pin 13 which is pressed downward by an elastic arm 15 of antenna element portion 12, it can take other configuration.

Figure 6:
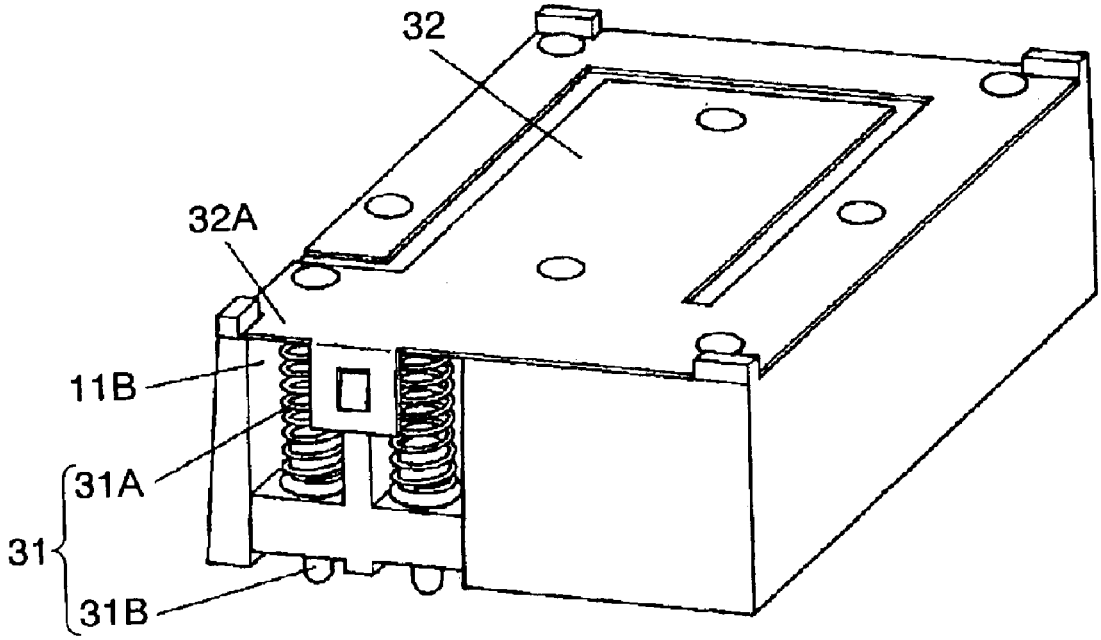
FIG. 6 is a perspective view showing a built-in type antenna in other exemplary structure of the present invention.
Figure 7:
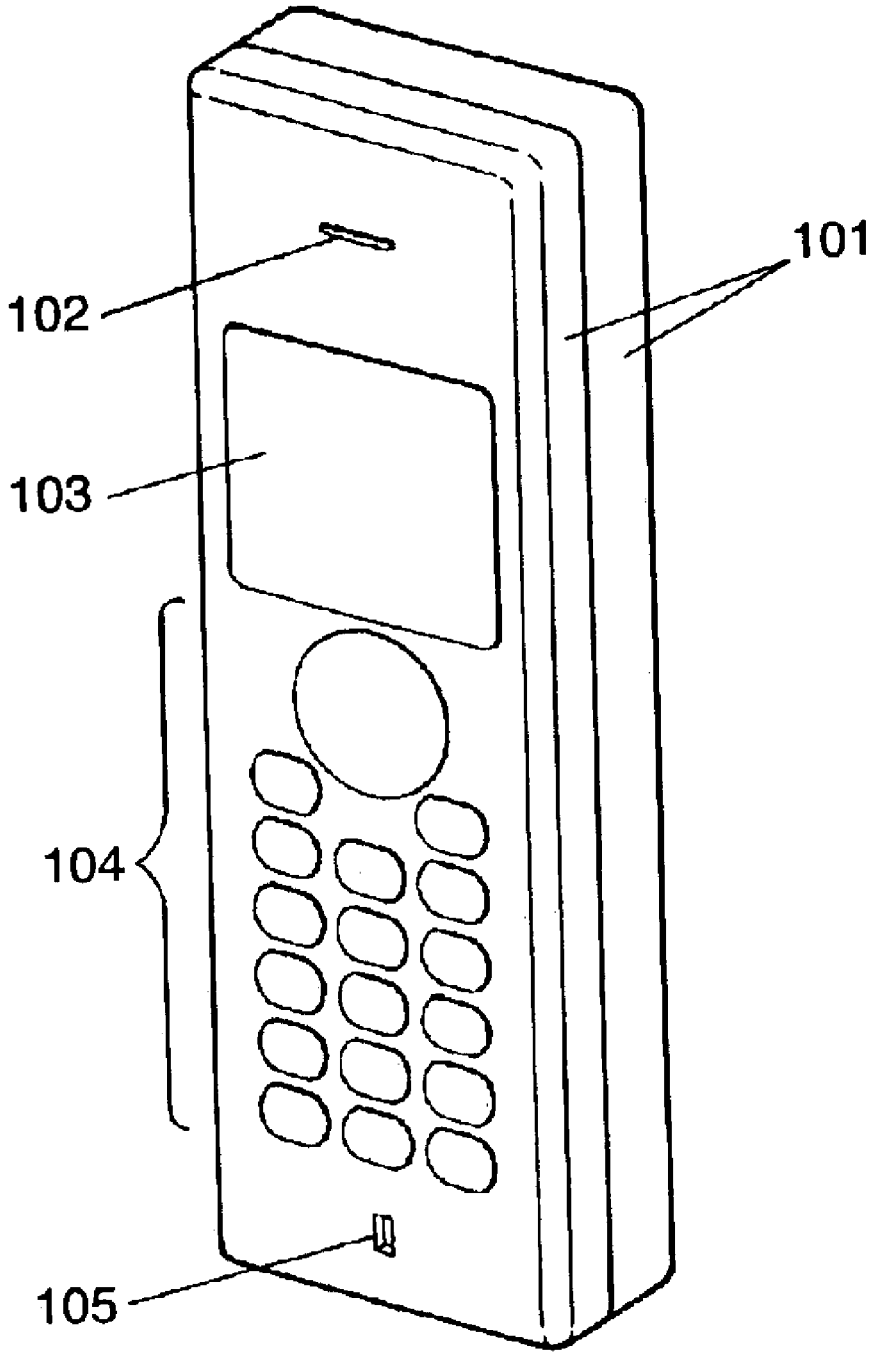
FIG. 7 PRIOR ART
FIG. 7 is a perspective view showing a communication equipment having a conventional built-in type antenna.
Figure 8:
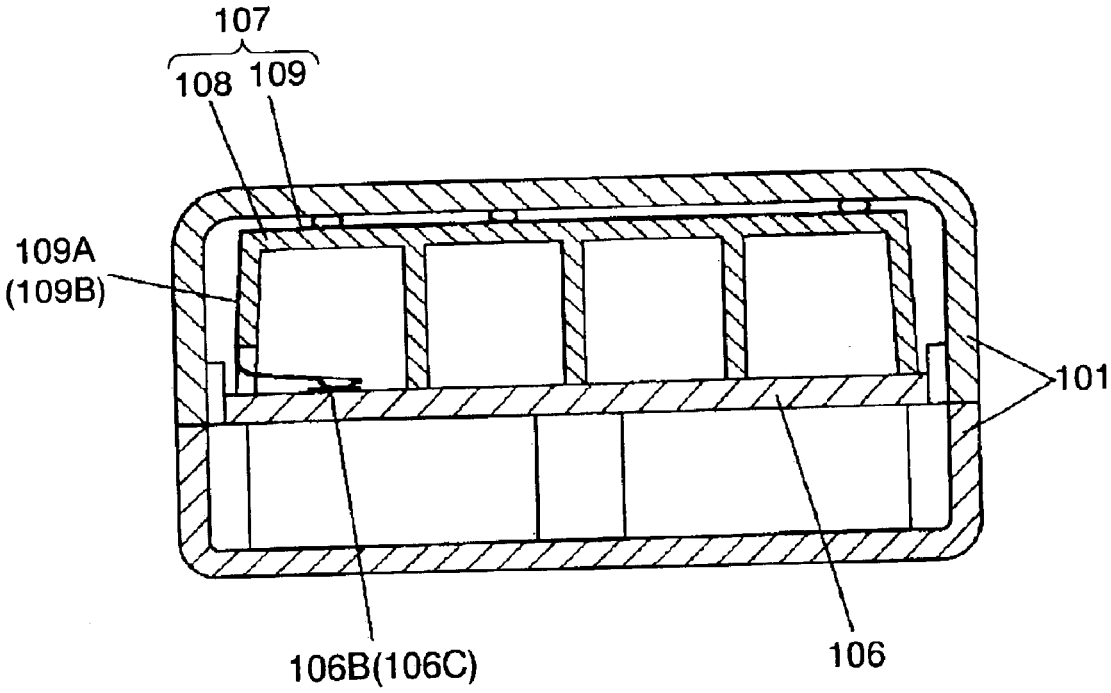
FIG. 8 PRIOR ART
FIG. 8 is a cross sectional view showing the key part of the communication equipment of FIG. 7. A state of antenna being mounted on the wiring board is shown.
Figure 9:
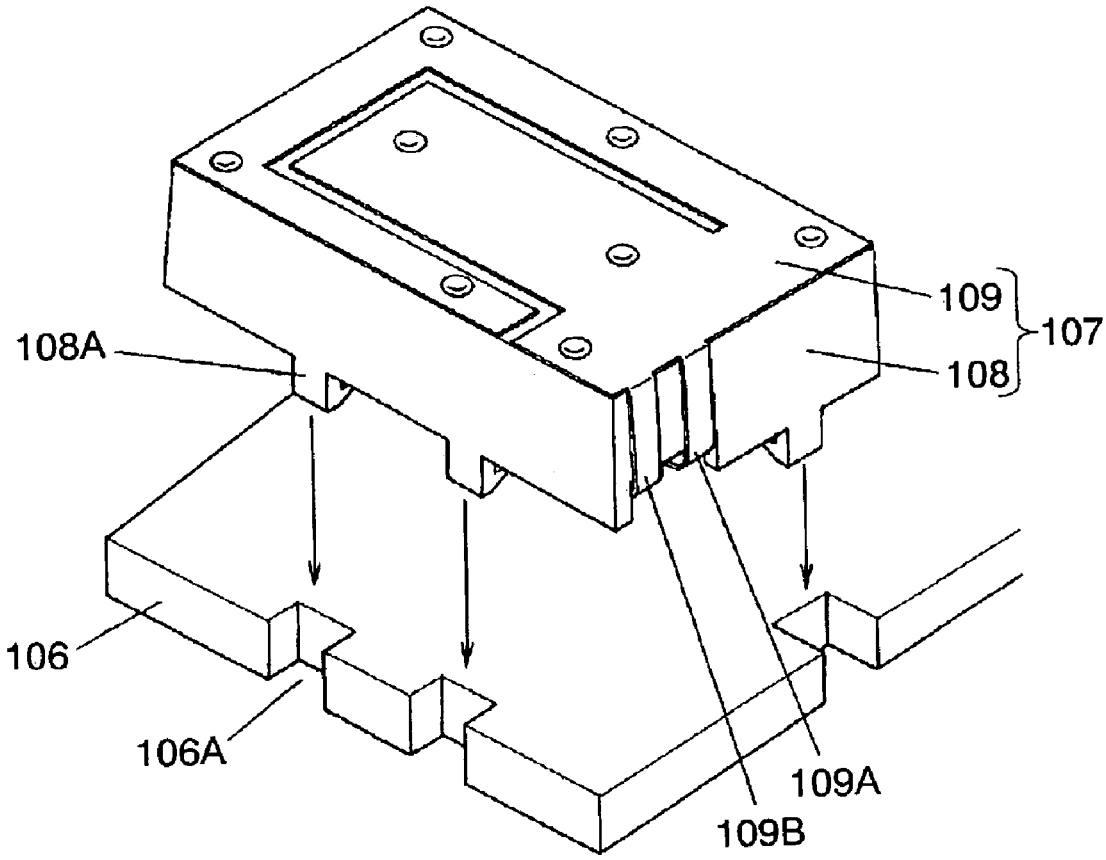
FIG. 9 PRIOR ART
FIG. 9 shows' a perspective view of a built-in type antenna, which antenna being the key part of communication equipment shown in FIG. 7.

FIG. 6, a perspective view, shows an example of such built-in antenna; where the conductive pin 31 is provided with own elastic portion.

The upper part of conductive pin 31 is provided with an elastic spring section 31A, the top end of which section is making elastic contact with an eaves part 32A of antenna element portion 32 locating above a groove 11B of base body 11. When the built-in antenna is mounted, the elastic spring section 31A is bent by an upward shift of conductive pin 31, and a resilient force deriving from it makes conductive pin 31 at the bottom end 31B to have an elastic contact with a wiring pattern 26A (not shown in FIG. 6). Thus the stable electrical connection between conductive pin 31 and wiring pattern 26A is implemented also with this model of a built-in antenna.

The elastic spring section 31A of conductive pin 31 may take a shape other than the illustrated coil form; it may take a shape of [<] in the side view, for example. When the elastic spring section 31A takes a coil shape, among other shapes, attention has to be paid on the diameter and the length of coil in the mounted state, because these factors give influence to the characteristics of the antenna. It is preferred to determine deliberately taking the above-described into consideration.

Still further, an elastic arm 15, which has been described in detail, may be used to give a pressure on the elastic spring section 31A of conductive pin 31.

A built-in antenna in the present invention implements an electrical connection between an antenna element portion and a wiring pattern of wiring board by having a conductive pin intervening between the two, which conductive pin being disposed movable ups and downs in the base body. Concept of the invention can be embodied in other different structures besides those already described in the above.

For example, a conductive pin disposed to be movable ups and downs in the base body may be pressed downward by a certain pressing member for making contact with a wiring pattern of wiring board, in order to implement an electrical contact between an antenna element portion and the wiring pattern. Such structures also fall within the scope of the present invention.

A base body of antenna may be held by a wiring board by means of an elastic claw in the same way as in the conventional configuration. Or, a screw bolt, a tape, etc. may be used for the purpose.

In the above-described structure, when holding force of the holding means is set to be higher than that of resilient force between the conductive pin and the wiring pattern after mounting so that the resilient force is absorbed, even an antenna alone can be mounted on a wiring board with a high mechanical stability. As a result, a stable electrical connection is implemented between conductive pin and wiring board.

The electrical connection on wiring pattern of wiring board can be managed easily with the built-in antennas in the present invention, and an area needed for implementing the electrical connection can be reduced.

Furthermore, the electrical connection in the present antenna is implemented by shifting a conductive pin disposed in the base body ups and downs to a wiring pattern of wiring board incorporated in a communication equipment, at a high targeting accuracy to a target point, which leads a least area needed for the connection. The use of a conductive pin for the connection facilitates an easier management of the connection and contributes to reduce troubles in the relevant parts during transportation and storage.

Still further, a structure in which the bottom end of a conductive pin makes an elastic contact on a wiring pattern of wiring board incorporated in an equipment by making use of a force generated as a result of up-down shift of conductive pin facilitates an easy implementation of a stable electrical connection between conductive pin and wiring pattern.

Since the conductive pin is seldom affected by a deformation trouble, the present built-in antenna can be managed with ease during transportation and storage. As a result, communication equipment incorporating the built-in antenna can enjoy a high reliability.

Still further; the base body is provided with a conductive pin holder and a conductive pin is disposed penetrating through the holder, thus the conductive pin is prevented from causing an inclination or other disorders. As a result, the bottom end of a conductive pin can target a certain specific place at a high accuracy, so a wiring pattern making contact with the bottom end can made finer.

The antenna element portion formed of a conductive metal sheet is provided with an elastic arm and the arm is used for pressing a conductive pin downward. Thus the overall up-down dimensions of the antenna element portion is reduced for a length corresponding to the intervening conductive pin. Therefore, management of these portions becomes easier. When mounting the built-in antenna on a wiring board, the conductive pin being pressed downward by the elastic arm is pushed up by the wiring board, and the conductive pin and wiring portion of wiring board are brought into contact with a certain predetermined contact pressure. This implements a stable state of electrical connection.

Since the elastic arm is formed in the side plate of antenna element portion and the side plate is provided with engagement means for engagement with base body, a possible upward deformation of side plate due to influence of resilient force of elastic arm can be prevented.

The brim provided at the top end of conductive pin, which brim having a diameter greater than that of conductive pin holder of base body, prevents a conductive pin from falling down through. This further makes it possible to insert a conductive pin halfway in the base body from the above and then letting the conductive pin to go down spontaneously. This makes it easy to introduce an automatic machine for the assembly operation.

An antenna which employs a conductive pin having elastic section can also implement an elastic contact of a certain predetermined force between the conductive pin and a wiring pattern of wiring board, when it is mounted by pushing a conductive pin up with a wiring board causing a bend in the elastic section. Thus an antenna of the present structure can also provide a stable electrical connection.

In a structure where a contacting protrusion provided at the upper part of base body is held pressed from the above by the inner surface of equipment case for regulating the positioning in up-down direction, antenna is firmly safeguarded against dislocation in the up-down direction, or the same direction as the shift action of conductive pin. Therefore, even if the antenna suffers from a shock caused by careless drop of an equipment, for example, the base body is not readily dislocated in the up-down direction. So, an influence to the connection between conductive pin and wiring pattern of wiring board is limited to a minimum.

In a structure where a base body is provided with means to hold a wiring board, and it is holding the wiring board with a holding force which is greater than that of resilient force of conductive pin making contact with wiring pattern of wiring board, an antenna alone can be mechanically mounted firm on a wiring board. Furthermore, the holding force that is set to be greater than resilient force of conductive pin absorbs an influence of the resilient force, and maintains a stable electrical connection between conductive pin and wiring pattern of wiring board.

In a communication equipment having the above-described antenna mounted on the wiring board, the antenna is electrically connected to a wiring pattern on the equipment's wiring board by means of conductive pin disposed in the antenna's base body. Since the antenna is electrically connected by means of a conductive pin, the electrical connection with antenna can be implemented within a smaller area. Furthermore, a communication equipment having the antenna can enjoy a high reliability.

What is claimed is:

1. An antenna comprising:

a base body having a first side, a second side, and an opening at the second side;

an antenna element portion attached and fixed on the first side and having a segment extending toward the opening; and a conductive pin coupled to the segment, to enable movement of the conductive pin within the opening;

wherein said antenna element portion includes a conductive metal sheet and further comprises an elastic arm, which elastic arm pressing said conductive pin downward.

2. The antenna of claim 1, wherein said base body has a conductive pin holder which holds said conductive pin by having it penetrating through.

3. The antenna of claim 1, wherein said antenna element portion further comprising a side plate, said side plate has said elastic arm, and said side plate is provided with engagement means for engagement with said base body.

4. The antenna of claim 2, wherein said conductive pin is provided at the top end with a brim, diameter of which brim being greater than a hole diameter of said conductive pin holder.

5. The antenna of claim 1, wherein said conductive pin has an elastic section.

6. The antenna of claim 1, wherein said base body is provided at the upper part with a contacting protrusion, which contacting protrusion being pushed down from the above by the inner surface of equipment case for position restriction in the up-down direction.

7. The antenna of claim 1, wherein said base body is provided with means to hold a wiring board, which holding means having a holding force that is greater than resilient force of said conductive pin making contact with wiring pattern of said wiring board.

8. A communication equipment having an antenna mounted on a wiring board, said antenna comprising:

a base body having a first side, a second side, and an opening at the second side;

an antenna element portion attached and fixed on the first side and having a segment extending toward the opening; and a conductive pin coupled to the segment to enable movement of the conductive pin within the opening, wherein said antenna is electrically connected with a wiring pattern of said wiring board by means of said conductive pin;

wherein said antenna element portion includes a conductive metal sheet and further comprises an elastic arm, which elastic arm Dressing said conductive pin downward.

* * * * *